US005299734A

United States Patent [19]

Lane

[11] Patent Number: 5,299,734

[45] Date of Patent: Apr. 5, 1994

[54] FOLDABLE CARTONS

[75] Inventor: Gordon S. Lane, Baldwinsville, N.Y.

[73] Assignee: Nestec S.A., Vevey, Switzerland

[21] Appl. No.: 74,074

[22] Filed: Jun. 8, 1993

Related U.S. Application Data

[63] Continuation-in-part of Ser. No. 807,459, Dec. 13, 1991, abandoned.

[51] Int. Cl.[5] ..... B65D 5/48

[52] U.S. Cl. ..... 229/120.32; 229/120.15; 229/161

[58] Field of Search ..... 229/120.15, 120.21, 229/120.32, 122.1, 161, 240, 242

[56] References Cited

U.S. PATENT DOCUMENTS

| | | |
|---|---|---|
| 1,168,565 | 11/1916 | Rosenwald . |
| 1,857,033 | 5/1932 | Sherman . |
| 2,758,774 | 8/1956 | Grunert et al. . |
| 3,013,710 | 12/1961 | Kronson et al. . |
| 3,086,690 | 4/1963 | Beck . |
| 3,111,222 | 11/1963 | Mueller, Jr. . |
| 3,111,223 | 11/1963 | Jacobi . |
| 3,587,837 | 6/1971 | Smith et al. . |
| 3,606,004 | 9/1971 | Fruehwirth . |
| 3,656,611 | 4/1972 | Mertz . |
| 5,002,221 | 3/1991 | Ragan . |

FOREIGN PATENT DOCUMENTS

| | | |
|---|---|---|
| 2947373A1 | 5/1981 | Fed. Rep. of Germany . |
| 1271139 | 7/1961 | France . |
| 78693 | 6/1951 | Norway . |
| 392376 | 9/1965 | Switzerland . |

OTHER PUBLICATIONS

Translation of French Patent No. 2,474,445, Jul. 1981

European Search Report for EP 92 11 9440, completed Mar. 1993.

Verpakking, vol. 15, No. 6, Feb. 1963, Rotterdam NL, p. 551 'Japans vouwcarton voor verpakken van borden'.

*Primary Examiner*—Gary E. Elkins

*Attorney, Agent, or Firm*—Vogt & O'Donnell

[57] ABSTRACT

A carton includes a longitudinally extending sidewall portion which circumscribes and defines a carton cross-section interior and is provided with at least two tiers of integral support ledges which extend into the carton interior. Each support ledge is formed from a pair of slits in the sidewall which extend integrally from and between spot creases formed in the sidewall, and each support ledge has at least two interior spot creases positioned between the end spot creases. The carton may have a rectilinear cross-section and longitudinally extending corner edges formed by adjacent sidewalls, and the slits which form the support ledge may be offset with respect to the corner edge formed by the adjacent sidewalls from and between which the slits extend.

14 Claims, 4 Drawing Sheets

FOLDABLE CARTONS

CROSS-REFERENCE TO RELATED APPLICATION

This is a continuation-in-part of U.S. patent application Ser. No. 07/807,459, filed Dec. 13, 1991, now abandoned.

BACKGROUND OF THE INVENTION

The present invention relates to cartons and to materials, processes and apparati for making cartons.

Various types of cartons have been made in the past which may be assembled by folding blanks of stock material. Notwithstanding the different approaches taken in the past, new concepts and new approaches are sought with a view to economically making on a mass scale single-piece foldable cartons which can support and/or separate products.

SUMMARY OF THE INVENTION

The present invention provides cartons, blanks for making the cartons and apparati and processes for assembling and filling the cartons.

The cartons of the present invention are generally characterized in that they have at least two tiers of integral infold support ledges which extend into the carton interior from a portion of the carton referred to hereinafter as the sidewall(s). These integral support ledges provide support for and/or separate products in the carton.

Each support ledge is formed from a pair of slits in the carton sidewall, preferably parallel slits of equal length, which extend integrally from and between end spot creases formed in the carton sidewall. Each support ledge has at least one interior crease positioned between the end spot creases, such as when the carton has open ends, but preferably each support ledge has at least two interior creases. The interior crease is generally oriented in a plane parallel to the end creases between which the support ledge extends.

In one embodiment of the carton of the invention, sidewalls extend between an open top and bottom of the carton, and each tier includes one, but preferably two or more support ledges.

In another embodiment, in which the carton is of rectilinear cross-section, and therefore has creased longitudinal corner edges formed by adjacent sidewalls, the paired slits which form a support ledge are parallel to one another, are of equal length, and are "offset" with respect to the creased longitudinal carton corner edge formed by the two adjacent sidewalls from which the slits extend. As discussed further below, this offset arrangement not only facilitates formation of the support ledges, it may be used to maximize surface area of at least one carton sidewall for printing, product-visualization windows, etc.

The carton blank of the present invention is characterized by a sheet of foldable material having at least two tiers of paired, preferably parallel, slits. Each slit of a pair is preferably of substantially equal length and each slit extends from and between transverse end spot creases formed in a sidewall portion of the blank. The slits form an area which, upon being impelled by an externally applied force, forms an integral support ledge extending towards the carton interior for supporting and/or separating products placed inside the carton.

The carton blank also includes a spot crease or creases which, upon folding, form(s) the interior crease(s) of the support ledge formed from the slits. The slits may extend completely through the sheet of foldable material along their entire length between the transverse end spot creases, but in one embodiment the slits do not extend completely through the sheet at points of intersection with the spot crease(s) which form the interior creases of the support ledge. As discussed further below, this configuration prevents the support ledges from being impelled prematurely, such as during folding and gluing operations.

The apparatus of the present invention for filling the carton is characterized in that it includes means for supporting a carton to be filled, means for introducing a product into the supported carton; and means positioned adjacent the carton supporting means for impelling an area between paired slits of the carton for forming support ledges which extend into the carton interior adjacent the introduced product.

The process of the present invention for filling the carton with product(s) is characterized by introducing a product into the interior of a carton having at least one open end and at least two tiers of paired slits which define areas which, upon being impelled by an externally applied force, form integral support ledges extending towards the carton interior for supporting and/or separating products placed inside the carton. At least one of the tiers of support ledge(s) is impelled towards the carton interior adjacent the product to secure it inside the carton in cooperation with either a closed end portion of the carton or a tier of support ledges which were formed prior to introduction of the product. A second product may be introduced into the carton so that it is separated from the first product by a tier of the impelled support ledges, and another tier of adjacent support ledges may be impelled to secure the second product inside the carton.

DETAILED DESCRIPTION OF THE INVENTION

The carton of the present invention may be configured in a variety of cross-sectional shapes, and such may be selected with a view to the product to be packaged therein. Preferably, the carton of the invention is rectilinear in cross-section, e.g., triangular, rectangular, square or polygonal, but it may also be circular or oval.

The carton of the present invention may be constructed from various packaging materials which can be cut, creased and folded, and which are sufficiently rigid to be self-supporting when folded into a carton having a geometrical cross-section. Various composite and noncomposite foldable materials may thus be used, and such include cardboards, e.g., claycoated or non-coated chipboard. Plastic materials, such as acetate or polyvinylchloride, may also be used. Corrugated cardboards, such as E Flute, and microfluted boards, such as MICROFLUTE, may also be used. Preferably, the carton is constructed from recycled cardboard.

The thickness of the foldable material may be selected based upon the nature of the material, and, of course, the nature of products which will be supported and/or separated by the support ledges of the carton. Preferably, the foldable material has a thickness of from about 0.015 inches to about 0.028 inches, more preferably from about 0.018 inches to about 0.024 inches.

When configured to hold foodstuffs which are to be thawed and/or heated, the carton of the invention may be constructed from a microwave transparent material which avoids arcing.

As indicated above, the integral support ledges of the carton are arranged in tiers, the spacing between tiers being selected based upon the dimensions, type and fragility of the product to be packaged. Each support ledge tier supports and/or separates one or more products within the carton. The number of tiers of support ledges may be from 2 to 6, and is preferably from 3 to 5.

Each tier may include one, but preferably includes two or more integral support ledges extending into the carton interior. When the carton is triangular, rectangular or polygonal in cross-section, for example, each support ledge extends from and between two adjacent sidewalls, traversing a longitudinal corner edge defined by the two adjacent sidewalls. For rectilinear cartons, the number of support ledges per tier is preferably the same as the number of sides of the carton.

As mentioned above, each integral support ledge is formed from a pair of slits in the carton sidewall, preferably parallel slits of equal length, which extend transversely from and between end spot creases formed in the carton sidewall. The width of the support ledge, i.e., the distance between the slits which form the ledge, is preferably sufficient to provide adequate rigidity and strength to support and/or separate products inside the carton without substantial deformation.

In general, as noted above, it is preferred that the slits are linear and parallel, although a nonlinear slit or slits may be used, e.g., convex or concave curved. Generally, a slit which defines a product-contacting portion of a support ledge will be linear.

It is also generally preferred that the width of the support ledge is less than the full length of the slits. In certain cases, as may be appreciated, it may be desirable for the width of the support ledge to be greater than the length of the slits. In some cases, the width of individual support ledges may vary from that of other ledges in a tier and/or from support ledges in different tiers.

The number and spacing of the interior creases provided in the integral support ledges contributes to the strength and rigidity of the ledges and of the carton itself, and such may be selected based upon the carton material, the product to be packaged, and the length of the slits.

As will be appreciated, in cartons having a rectilinear, e.g., quadrilateral, cross-section, one of the interior spot creases of a formed support ledge will be positioned such that it aligns with the longitudinally extending corner edge defined by adjacent sidewalls of the carton when the formed support ledge is impelled towards and in alignment with the carton sidewall. The paired slits which form the support ledge may be "centered" on the longitudinal corner edge they traverse, extending equal distances on each adjacent sidewall to the transverse end spot creases from which they extend, but it is preferable that the slits be offset vis-á-vis the corner edge, so that the slit is longer on one adjacent sidewall than on the other. This configuration eases formation of the support ledge by reducing stiffness sometimes experienced with slits centered on the corner edge.

In addition, when support ledges are provided in each corner of a carton having a rectilinear cross-section, i.e., when the tier includes the same number of support ledges as carton sides, surface area of at least one carton wall may be maximized by positioning the "short" end of the offset slits on the same wall.

The carton of the invention may be configured and used to support and/or separate various comestible products, such as cookies, bakery products, breakfast and snackfoods, such as frozen bagels, waffles and french toast. They may be used as well for domestic and noncomestible products, such as glassware, compact discs, computer discs and/or game cartridges and novelty items.

Light bulbs, including pear-shaped incandescent and tubular fluorescent, may be conveniently supported, and separated, if packaged in pairs as in the case of incandescent bulb, in a carton of the invention which has an open top and bottom and which has one, preferably two, support ledges per tier. Such a carton, which may be circular or rectilinear in cross-section, e.g., square or triangular, obviates the use of internal dividers commonly used in multi-bulb cartons. Material as well as manufacturing costs are thus reduced by the single-piece carton of the invention, and the bulbs may be stored, transported and/or packed or removed from larger containers with reduced risk of breakage and/or injury.

Cartons of circular cross-section, e.g., tubular cartons having open ends, may also be advantageously employed to store and/or transport items such as blueprints, diplomas, and the like. A single support ledge per tier, positioned adjacent opposite ends of the product, may be sufficient for securing the product in the carton, but two or more support ledges per tier, or more than two tiers, may be provided if necessary. When constructed of a durable material, such tubular cartons provide reusable carrying and/or storage cases.

Depending upon the product, the carton of the invention may be provided with cut-outs or windows for visualizing the product, and such may be covered, if desired, with a transparent material familiar to those in the packaging art. Sidewalls of the carton may contain printed information, and, as indicated above, the area for such printing is conveniently optimized by offsetting the support ledge-forming slits vis-á-vis the corner carton edge they traverse.

Products may be introduced and separated from one another inside the carton individually or in groups of two or more, and they may be packaged or wrapped. Individually wrapped cookies or pairs of cookies, for example, may be placed in the carton, providing both portion control and enhanced shelf life and preservation, since not all cookies are exposed to the atmosphere at one time.

When the carton of the invention contains foodstuffs which are to be thawed and/or heated, the carton may be exposed to a microwave source, e.g., placed inside a microwave oven, for a time sufficient to achieve the desired thawing, heating and/or cooking. The openings where the support ledges extend into the carton advantageously provide vents for releasing moisture and gases generated by heating, thereby rendering unnecessary mechanical introduction of slits in the carton which might deform the food product contained therein. To provide optimal heat distribution, the carton may be placed on its side within the microwave cavity, so that the separated products are positioned in quasi-parallel vertical planes. Depending upon the product, of course, it may be possible to position the carton so that the products contained therein are in parallel horizontal planes.

Depending upon the nature of the product(s) supported and/or separated therein, the carton of the invention may generally be transported on its side, so that the weight of the product is supported principally by the sidewall, rather than by the support ledges.

Although it is possible to manufacture the carton of the invention in a variety of ways, it is preferred that it be made from a carton blank which comprises a single sheet of foldable material which may be folded, glued, packed and sealed by machine. The blank sheet may be provided with preformed creases which, upon folding, define longitudinally extending parallel corner edges of the carton. The sidewall portion is provided with two or more tiers of paired, preferably parallel, slits which extend from and between transverse end spot creases. The slits and end creases define and form the impellable area which will eventually become the support ledges. The blank may also include preformed creases which define the interior creases of the support ledges.

As noted above, the paired slits which form the support ledges may extend completely through the carton blank sheet along their entire length, but it is preferred that the slits do not extend through the blank sheet adjacent points of contact with the transverse interior crease(s) of the support ledge. This prevents the support ledges from being impelled prematurely, such as during folding and gluing of the blank to form the carton. Each slit may thus comprise one or more portions which do not extend all the way through the blank sheet, depending upon the number of interior creases.

In the case of a support ledge having two interior creases, for example, there are four potential areas where the slits may not extend completely through the blank sheet. It is preferred, however, that the slits do not extend completely through the blank sheet at each intersection with an interior crease. Preferably, the "nick " or portion of the slit which does not extend completely through the blank sheet extends at least about 50%, more preferably at least about 75%, through the blank sheet.

The blank may have top and bottom spot creases and may also have portions extending therefrom, respectively, which may be folded to form the top and bottom of the carton. For example, the carton may be provided with a standard tear strip self-locking top closure. If desired, the carton may also be provided with a locking tab system at the top and/or bottom.

The carton blank of the invention may be made in various ways, but it is preferably made using die cutting techniques familiar to those in the art. For example, a die board may be used, having cutting blades and blunt protrusions embedded therein which correspond to the positioning of the slits and spot creases to be formed in the sheet of material which forms the carton blank. The cutting blades may be machined so that portions thereof do not pass completely through the sheet at points along the slits where only nicks are desired.

The cut and creased blank sheet may be printed, partially folded and then glued along the outer longitudinal edges to define the eventual geometrical cross-section of the carton, although the blank at this point may still lay flat. Preparatory to filling, the partially assembled carton may be erected to define the cross-section interior, and one end of the carton may be closed, depending upon its configuration, by folding and/or gluing locking tabs, etc. When the carton has open ends, one tier of support ledges may be impelled.

A product may then be introduced into the carton through the open top or bottom and an adjacent tier of support ledges may be impelled to secure the introduced product inside the carton. This operation may be performed manually but is preferably carried out with automatic synchronized machinery.

For example, after the first product has been introduced into the carton, e.g., has been introduced through the top and has fallen to the bottom of a closed-end carton, mechanical impelling means, e.g., pneumatic pushers positioned around the perimeter of the carton, may be actuated to tuck in the support ledges adjacent, i.e., above the product. The carton is then displaced, e.g., vertically, to align the impelling means with the next tier of slits, a second product enters and falls on the tier of formed support ledges, and the pneumatic pushers tuck in a second tier of support ledges above the second product. This procedure is continued until the carton is filled with product, each product being separated from the other by a tier of support ledges.

The present inventions are further illustrated, in a nonlimitative manner, by the accompanying drawings.

DETAILED DESCRIPTION OF THE DRAWINGS

Figure 1:
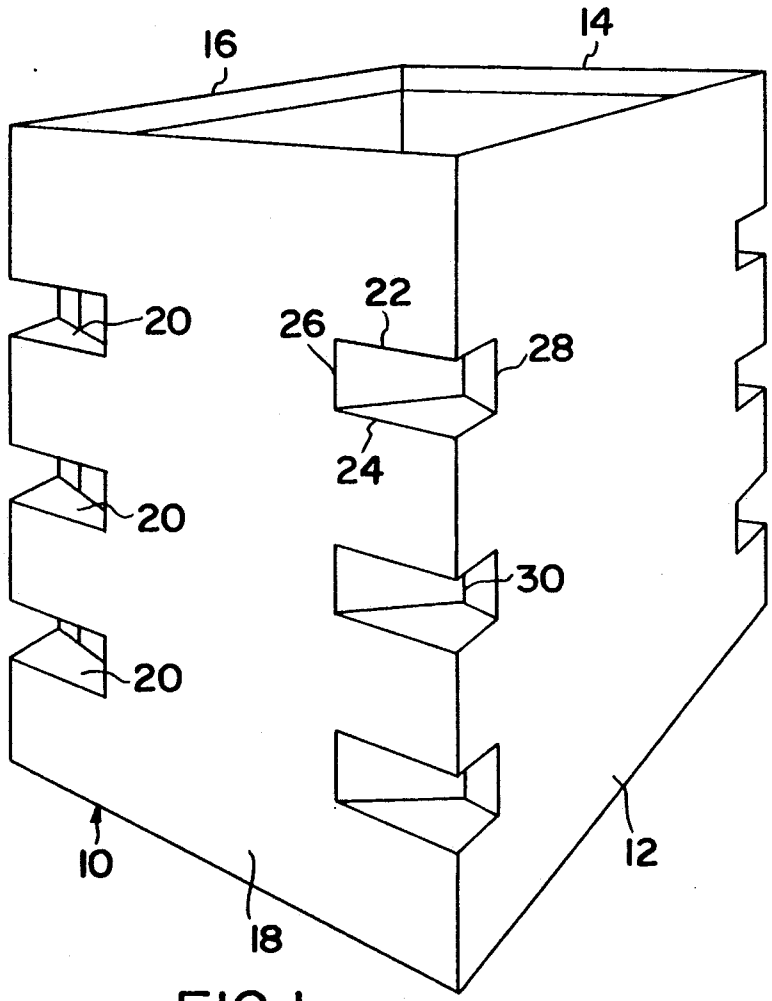
FIG. 1 is a perspective view of a carton of the invention in which the integral support ledges have one internal crease.

As illustrated in FIG. 1, carton 10 has four sidewall portions 12, 14, 16, 18 which extend longitudinally from opposed open ends and which circumscribe and define a carton interior having a square cross-section. Three spaced tiers of integral support ledges 20 are provided in carton 10, forming an internal divider support system for one or more products, e.g., individually wrapped cookies.

Each support ledge 20 of carton 10 is formed from a pair of parallel slits 22, 24 which extend from and between end creases 26, 28 which are formed, respectively, in sidewall portions 18, 12. Each support ledge 20 has one interior crease 30 positioned between and oriented in a plane parallel to the respective end creases 26, 28.

Figure 2:
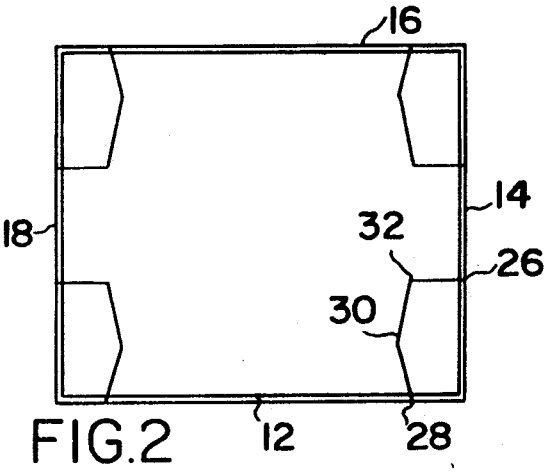
FIG. 2 is a top view of a carton of the invention in which the integral support ledges have two internal creases.
Figure 3:
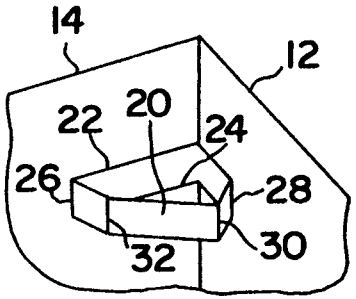
FIG. 3 is a perspective view of a support ledge extending inside the carton of FIG. 2.

In the embodiment illustrated in FIGS. 2 and 3, each support ledge 20 extends integrally from and between opposed carton wall end creases 26, 28 which are formed in the carton and has two interior creases 30, 32 positioned between the end creases 26, 28. As illustrated in FIG. 3, support ledge 20 is formed from parallel slits 22, 24 which traverse adjacent walls 12, 14, the portion of the slits on wall 12 being shorter than the continuing portion on wall 14. As discussed above, this configuration not only increases the surface area on wall 12 for printing, windows, etc., as can also be seen from FIG. 1, it eases formation of the support ledge by reducing stiffness.

Figure 4:
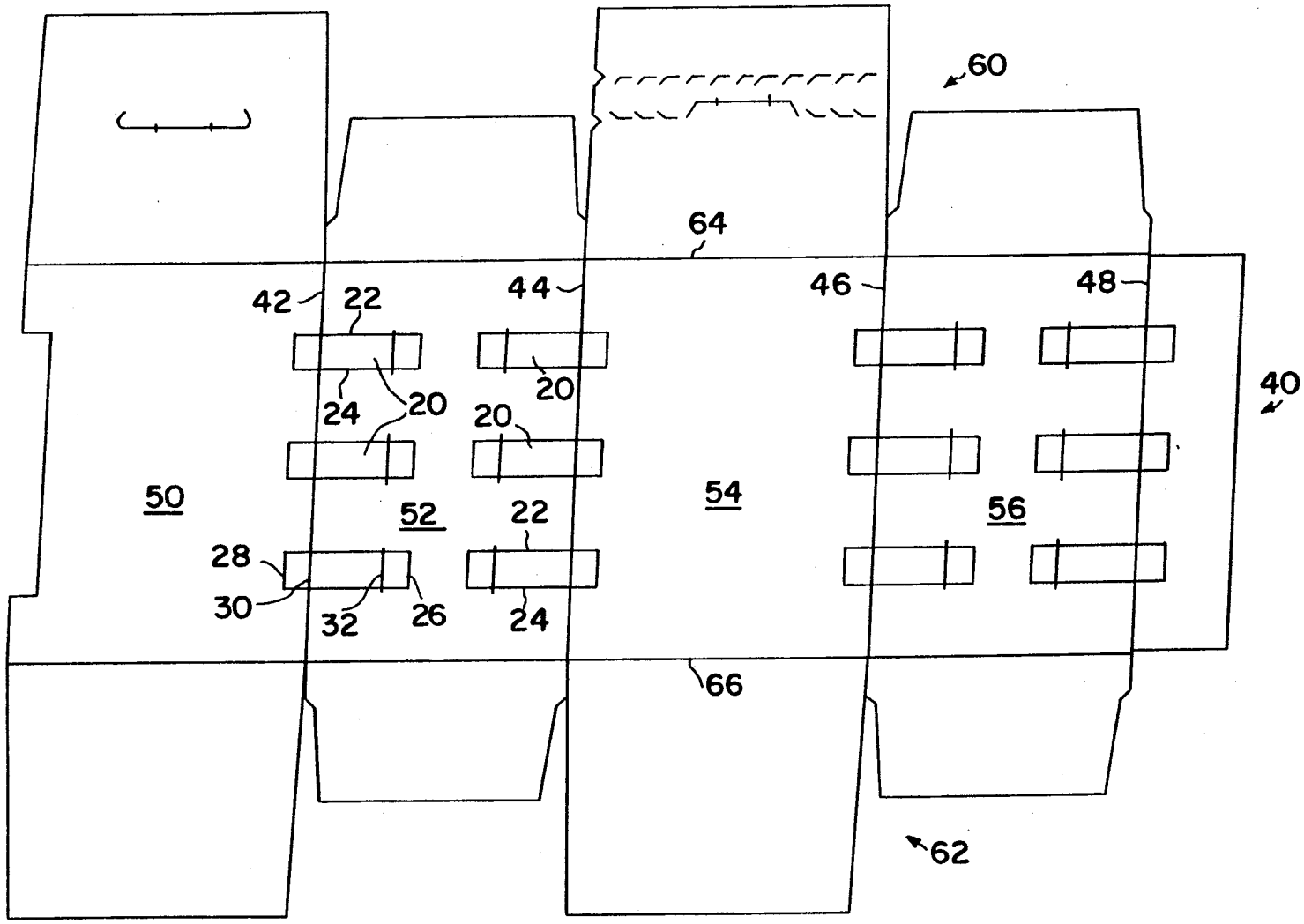
FIG. 4 is a plan view of a blank for preparing a carton according to one embodiment of the invention, having a tear strip self-locking top closure and bottom closure.
Figure 5:
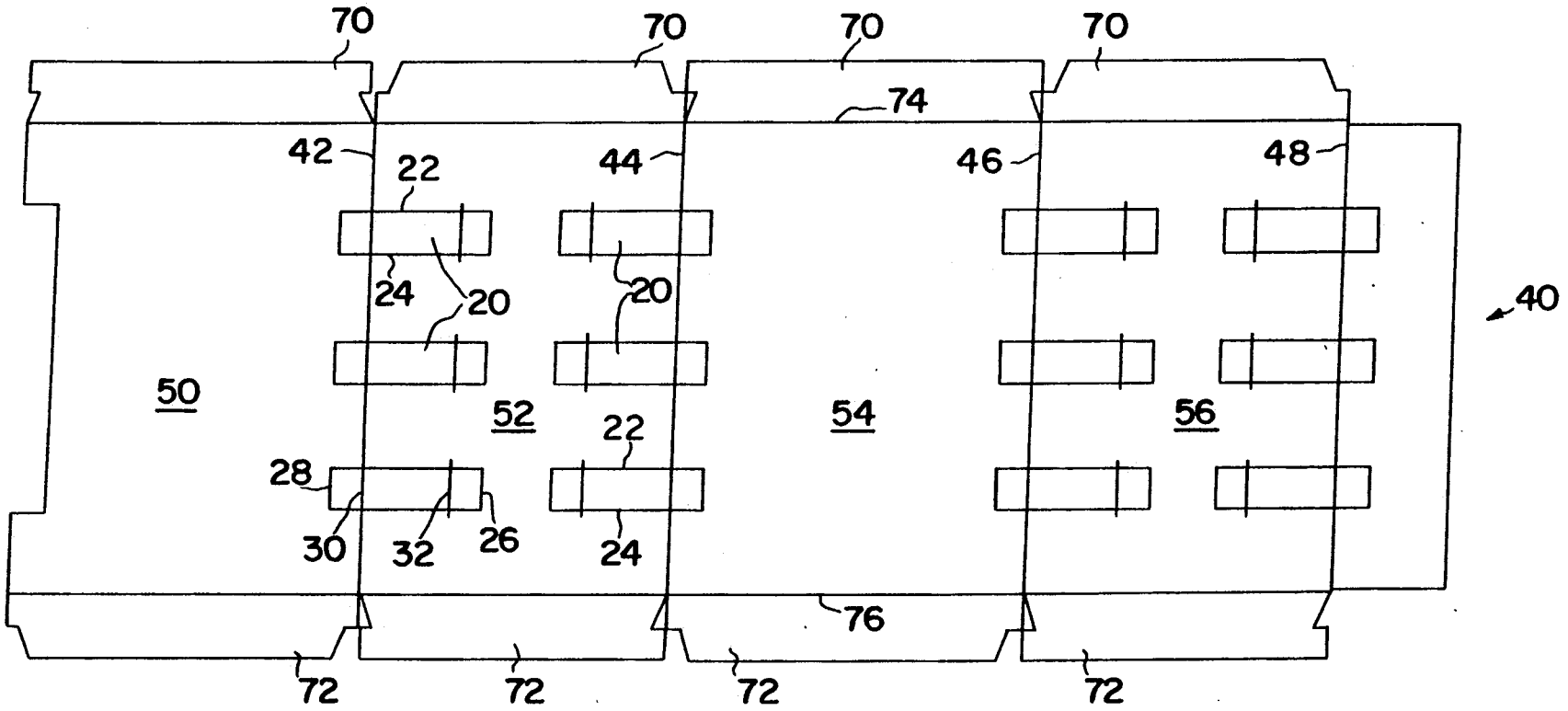
FIG. 5 is a plan view of a blank for preparing a carton according to another embodiment of the invention, having a locking tab system which provides opposing open ends.

FIGS. 4 and 5 each illustrate blanks which can be folded and glued to make a carton of the invention. Each blank comprises a foldable sheet of material 40 having parallel, longitudinal crease lines 42, 44, 46, 48, for defining four sidewalls 50, 52, 54, 56 which, upon folding and gluing, circumscribe and define a carton interior having square cross-sectional configuration.

Twelve pairs of parallel slits 22, 24 in sheet 40 provide three tiers of support ledges 20, which are punched or impelled towards the carton interior after sheet 40 is folded into a carton having a cross-sectional interior. Slits 22, 24 extend from and between end spot creases 26, 28, which are channels formed by applying a blunt or impression-making object against sheet 40, thus forming a depression. Between end creases 26, 28 are interior creases 32, 30, which allow for folding, and enable the support ledges 20 to be pushed by external force towards the interior of the formed carton. As can be seen, interior spot crease 30 aligns with longitudinal crease line 42 until support ledge 20 is pushed towards the carton interior.

Slits 22, 24 are cut completely through sheet 40 except at the four points of intersection with interior creases 30, 32, where there are nicks which pass through approximately 75% of sheet 40. This arrangement helps prevent support ledges 20 from extending out of the plane of sheet 40 before desired, such as during the printing and/or gluing stages of carton assembly.

The blank shown in FIG. 4 is provided with top and bottom tab portions 60, 62 which, upon folding, produce a standard tear strip self locking top closure and a base with three layers of material. Tab portions 60, 62 extend, respectively, from parallel edge crease lines 64, 66, which are orthogonal to and intersect with longitudinal crease lines 42, 44, 46, 48.

The blank shown in FIG. 5 is provided with top and bottom tab portions 70, 72 which, upon folding, produce a locking tab system which provides an open top and bottom, such as illustrated in FIG. 1. Tab portions 70, 72 extend, respectively, from parallel edge crease lines 74, 76, which are orthogonal to and intersect with longitudinal crease lines 42, 44, 46, 48.

As will be appreciated by one skilled in the art, the blanks of the invention may be assembled into cartons of the invention and then filled with product by hand, in which case the support ledges may be formed by finger-pressing the sidewall portions of the carton between the paired slits towards the carton interior, but they are preferably assembled and filled by automated and synchronized machinery which folds and glues the blank, and partially forms the carton, leaving at least one end accessible for introducing product. For example, machines of the type customarily used to fold, glue, and assemble cartons, e.g., in-line gluers and collation equipment, may be used and adapted as desired.

Generally, an apparatus for filling a carton of the invention will include support means for holding an empty carton; means for delivering product to and into a carton; and pressing means positioned and configured for forming support ledges. Additional elements, such as control and/or sensor means,, e.g., computers, photoelectric eyes, as well as conveyor means, e.g., for delivering unfilled cartons to the apparatus and transporting filled cartons away from the apparatus, may also be utilized.

Figure 6:
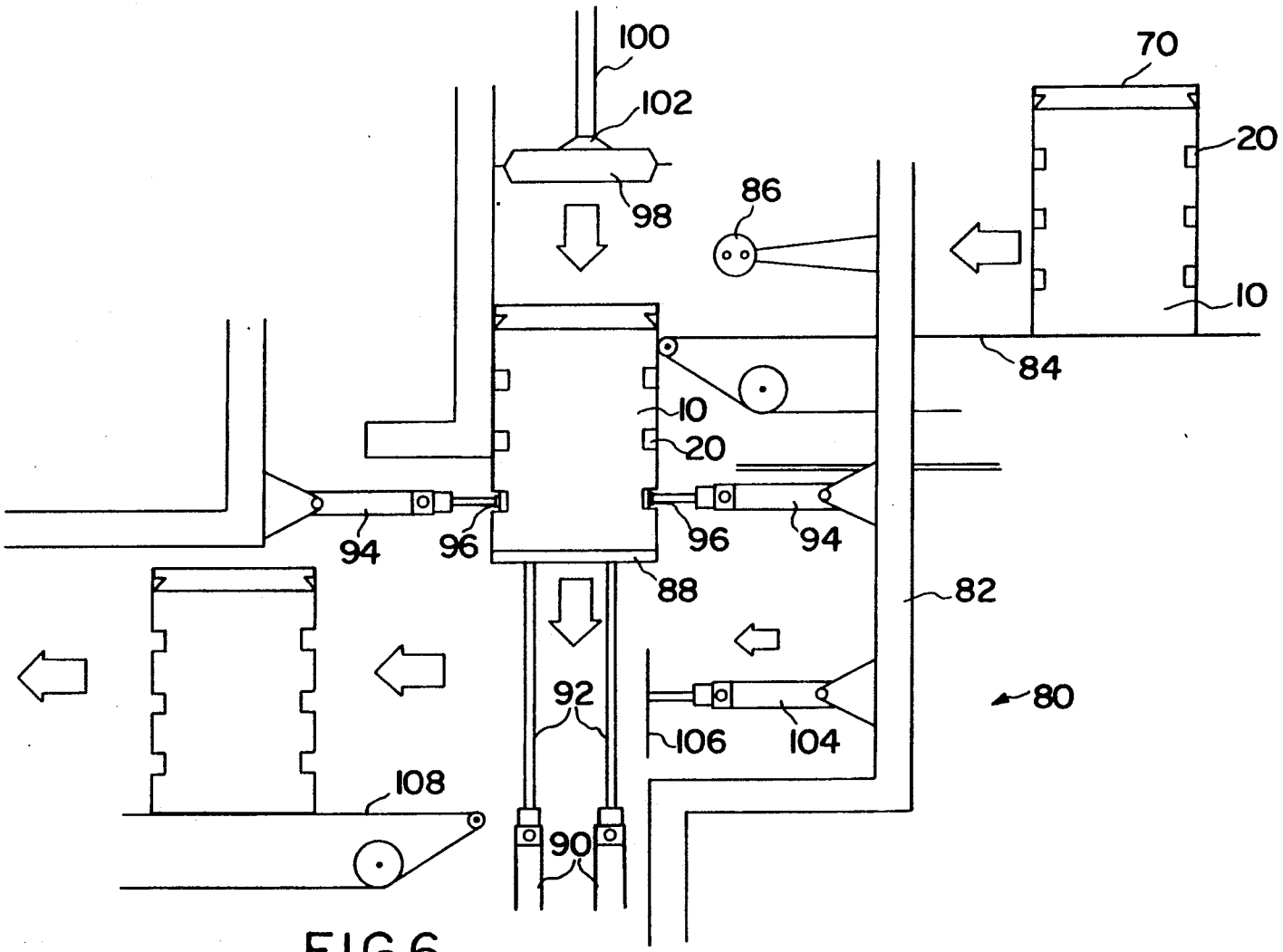
FIG. 6 is a diagrammatic side sectional view of an apparatus for filling a carton of the invention.

An apparatus for filling a carton of the invention is illustrated in FIG. 6. It includes a collator, generally represented by reference numeral 80, having a framework 82, means for conveying an empty carton to the collator, such as an intermittently traveling infeed belt 84, carton sensor means, such as a photoelectric eye 86, means for receiving and supporting a carton, such as a rectangular flatbed 88, preferably adapted to descend intermittently by means of pneumatic cylinders 90 and piston rods 92, a tier of four pneumatic cylinder units 94 provided with pushers 96 (only two shown) positioned above the corners of the flatbed 88, a "pick and place" mechanism for gathering and feeding product 98 to the carton 10 comprising a pneumatic arm 100 assisted by a vacuum distribution head 102, a pneumatic cylinder 104 with a pusher 106 and an outfeed belt 108.

To fill a carton with product 98, such as individually wrapped cookies, the carton 10, which has been printed and glued along longitudinal edges to define the cross-sectional configuration, is held in a flat folded position in a hopper (not shown) and then pulled by means of an air suction cap (also not shown) into a configuration ready for impelling support ledges 20 and for inserting top locking tabs 70. In so moving the carton 10 into position, the base portion tabs 72 are folded upwards, thus locking the base tabs into place. If the carton is to have a closed bottom, bottom potions of the blank are folded into the desired overlapping configuration and glued to secure the bottom.

The partially assembled carton 10 is then transported on infeed belt 84 past the photoelectric eye 86 to carton collator 80. In particular, the carton is positioned on flatbed 88, which descends by means of pneumatic cylinder 90 and piston rods 92 to a position where the portion of the wall of the carton corresponding to the lowest tier of support ledges 20 lies opposite the tier of pneumatic cylinder units 94 and pushers 96. The next carton traveling on the infeed belt 84 activates the photoelectric eye 86 which causes a control device (not shown) to stop the belt until the carton on the flatbed 88 has been filled and then transported away, after which the infeed belt 84 restarts and conveys the next partially assembled empty carton to the flatbed 88.

Products 98 are gathered and fed one by one into the carton by a "pick and place" mechanism comprising pneumatic arm 100 and vacuum distribution head 102. After a first product has been delivered into, e.g., has fallen to the bottom of the carton, pushers 96 tuck in all four support ledges 20 of the lowest tier in a single stroke. A second product 98 is then fed into the carton and falls to lie on the tier of support ledges just formed. The flatbed 88 then descends to a position where the portion of the wall corresponding to the second lowest tier of infolds is surrounded by pneumatic cylinder units 94 and pushers 96, which tuck in all four support ledges of the second lowest tier in a single stroke. This procedure is continued until the carton is filled with products separated from each other by a tier of support ledges, all products except the lowest being supported by a tier of support ledges.

The filled carton is pushed off the flatbed 88 by pneumatic cylinder 104 and pusher 106 onto conveyor 108, which transports the filled carton to means for securing the carton top, e.g., folding, locking, and/or gluing the top portions of the carton, if any. When the filled carton is displaced from flatbed 88, the next empty carton is fed into carton collator 80 from infeed belt 84.

All the foregoing structural elements and manipulative steps are synchronized by a suitable control means,, e.g., a computer or microprocessor, which receives and processes information regarding the stage of filling and enables the carton to be filled consecutively with products.

The inventions described above may be modified, and may, in particular, be carried out without departing from the scope of the disclosure in the absence of structural elements and manipulative steps not specifically disclosed herein.

I claim:

1. A carton comprising a longitudinally extending sidewall portion which circumscribes and defines a carton cross-section interior and at least two tiers or integral support ledges for positioning a product in the carton which extend into the carton interior, each of the support ledges being formed from a pair of slits in the sidewall portion which extend integrally from and between end spot creases formed in the sidewall portion and each of the support ledges having at least two interior spot creases positioned between the end spot creases.

2. A carton according to claim 1 wherein the carton sidewall portion extends between an open top and bottom of the carton.

3. A carton according to claim 1 wherein each of the tiers comprises at least two of the support ledges.

4. A carton according to claim 1 wherein the sidewall portion comprises adjacent sidewalls, wherein the carton cross-section interior is rectilinear, wherein the carton comprises longitudinal corner edges formed by the adjacent sidewalls, and wherein the paired slits which form each of the support ledges are of substantially equal length, parallel to one another and offset with respect to a respective one of the longitudinal corner edges formed by the adjacent sidewalls from and between which the slits extend.

5. A carton according to claim 4 wherein the carton cross-section interior is triangular, rectangular or polygonal.

6. A carton according to claim 4 wherein the carton cross-section interior is square and each of the tiers comprises four support ledges.

7. A carton according to claim 1 further comprising a self-locking tear-strip top closure.

8. A carton blank comprising a sheet of foldable material provided with at least two tiers of paired slits which extend between end spot creases formed in a carton sidewall portion of the sheet and which form an area which, upon being impelled by an externally applied force, forms an integral support ledge for securing a product in a carton constructed from the blank, and at least two interior spot creases positioned between the end spot creases from which the slits extend.

9. A carton blank according to claim 8 wherein the foldable sheet further comprises longitudinally extending parallel creases which form corner edges of the carton upon folding of the blank.

10. A carton blank according to claim 9 wherein the paired slits are of substantially equal length, parallel, and offset with respect to at least one of the longitudinal corner creases which they traverse.

11. A carton blank according to claim 8 wherein the paired slits pass completely through the foldable sheet between the end spot creases from which they extend.

12. A carton blank according to claim 8 wherein the paired slits do not pass completely through the foldable sheet at points of intersection with the interior spot creases.

13. A carton blank according to claim 12 wherein the slits comprise nicks which pass at least about 50% through the foldable sheet at the points of intersection with the interior spot creases.

14. A carton blank according to claim 13 wherein the nicks pass at least about 75% through the foldable sheet at the points of intersection with the interior spot creases.

* * * * *

UNITED STATES PATENT AND TRADEMARK OFFICE

CERTIFICATE OF CORRECTION

PATENT NO. : 5,299,734

DATED : April 5, 1994

INVENTOR(S) : Gordon S. LANE

It is certified that error appears in the above-identified patent and that said Letters Patent is hereby corrected as shown below:

Column 9, line 16 (line 3 of claim 1), "or" should be --of--.

Signed and Sealed this

Fifth Day of July, 1994

Bruce Lehman

*Attest:*

BRUCE LEHMAN

*Attesting Officer*

*Commissioner of Patents and Trademarks*